US009790628B2

(12) United States Patent
Massotte

(10) Patent No.: US 9,790,628 B2
(45) Date of Patent: Oct. 17, 2017

(54) DEVICE FOR SPREADING YARN ON A CONVEYOR STRUCTURE

(71) Applicant: Superba S.A.S., Mulhouse (FR)

(72) Inventor: Philippe Massotte, Gueberschwihr (FR)

(73) Assignee: Superba S.A.S., Mulhouse (FR)

( * ) Notice: Subject to any disclaimer, the term of this patent is extended or adjusted under 35 U.S.C. 154(b) by 174 days.

(21) Appl. No.: 14/730,289

(22) Filed: Jun. 4, 2015

(65) Prior Publication Data

US 2015/0368839 A1 Dec. 24, 2015

(30) Foreign Application Priority Data

Jun. 18, 2014 (EP) ..... 14305940

(51) Int. Cl.
*D06B 17/00* (2006.01)

(52) U.S. Cl.
CPC ..... *D06B 17/005* (2013.01)

(58) Field of Classification Search
CPC ..... B65H 54/76; B65H 54/80; B65H 54/82; D06B 17/005; D06B 23/04
See application file for complete search history.

(56) References Cited

U.S. PATENT DOCUMENTS 5,934,108 A * 8/1999 Berns'Au ..... B65H 54/82 68/5 D

FOREIGN PATENT DOCUMENTS

| | | | |
|---|---|---|---|
| EP | 0298519 | A1 | 1/1989 |
| EP | 0353617 | A1 | 2/1990 |
| EP | 0640551 | A1 | 3/1995 |
| FR | 2581631 | A1 | 11/1986 |
| GB | 2010931 | A | 7/1979 |
| JP | 51123311 | | 10/1976 |

OTHER PUBLICATIONS

Europe Patent Application No. 14305940.0, Search Report dated Nov. 25, 2014, 5 pages.

* cited by examiner

*Primary Examiner* — William E Dondero
(74) *Attorney, Agent, or Firm* — Kilpatrick Townsend & Stockton LLP; Dean W. Russell; Renae Bailey Wainwright

(57) ABSTRACT

Disclosed is a device for spreading at least one yarn on a conveyor structure, the device including a rotating structure operated by a motor and having at least one point for supplying yarn in the region of the axis of rotation of the rotating structure. The device also includes a channel directed inside the rotating structure, radially in relation to the axis of rotation of the rotating structure, and opening out in the region of an orifice for outputting the yarn which is radially offset in relation to the axis of rotation of the rotating structure. The device further includes a spreader plate which is axially mounted on the rotating structure and comprises the orifice for outputting yarn and is intended to be positioned in the plane and against the surface of the conveyor structure.

9 Claims, 3 Drawing Sheets

DEVICE FOR SPREADING YARN ON A CONVEYOR STRUCTURE

CROSS REFERENCE TO RELATED APPLICATION

The present invention claims the benefit of European Patent Application No. 14305940.0 filed Jun. 18, 2014, the contents of which are incorporated herein by reference in its entirety.

TECHNICAL FIELD

The present invention relates to the field of yarn treatment systems and more particularly to the field of devices for distributing and positioning yarn on a conveyor structure.

BACKGROUND

At present the treatment of yarns intended for the manufacture of clothing involves in particular an autoclave vaporization step in order to ensure dimensional stabilization of the yarn and elimination of the tension in the yarn structure. This operation is performed continuously by means of displacement of the yarn unwound from a spool inside the autoclave.

However, such a mechanism results in a maximum speed limit which is rapidly reached during treatment of the yarn. In fact, since the vaporization step requires a minimum duration of treatment, the speed at which the yarn moves inside the autoclave is limited. Thus, in order to optimize the vaporization step, it is known to deposit the yarn to be treated on a conveyor structure in a particular spiral arrangement.

However, this spiral depositing operation rapidly encounters difficulties in uniform execution of the operation, owing to the intrinsic characteristics of the yarns intended for the manufacture of clothing and especially because of the particular tension which exists in the fibers forming the structure of these yarns. This specific tension in the fibers of the yarns conditions the depositing of the yarn which limits the maximum speed of this depositing operation.

BRIEF SUMMARY

The object of the present invention is to remedy these drawbacks by proposing a device able to achieve a homogeneous and sustained distribution of yarns on a conveyor structure while allowing a yarn depositing speed of the order of at least 1000 meters per minute.

The object of the invention is thus to provide a device for spreading at least one yarn on a conveyor structure, wherein the device comprises:

- a rotating structure operated by a motor and comprising at least one point for supplying the yarn in the region of the axis of rotation of the rotating structure;
- a channel directed inside the rotating structure, radially in relation to the axis of rotation of the rotating structure, and opening out in the region of an orifice for outputting the yarn which is radially offset in relation to the axis of rotation of the rotating structure;
- a spreader plate which is axially mounted on the rotating structure and comprises the orifice for outputting the yarn and is intended to be positioned in the plane and against the surface of the conveyor structure.

BRIEF DESCRIPTION OF THE DRAWINGS

The invention will be better understood in the light of the description below which relates to a preferred embodiment provided by way of a non-limiting example and described with reference to the attached schematic drawings in which.

DETAILED DESCRIPTION

Figure 1:
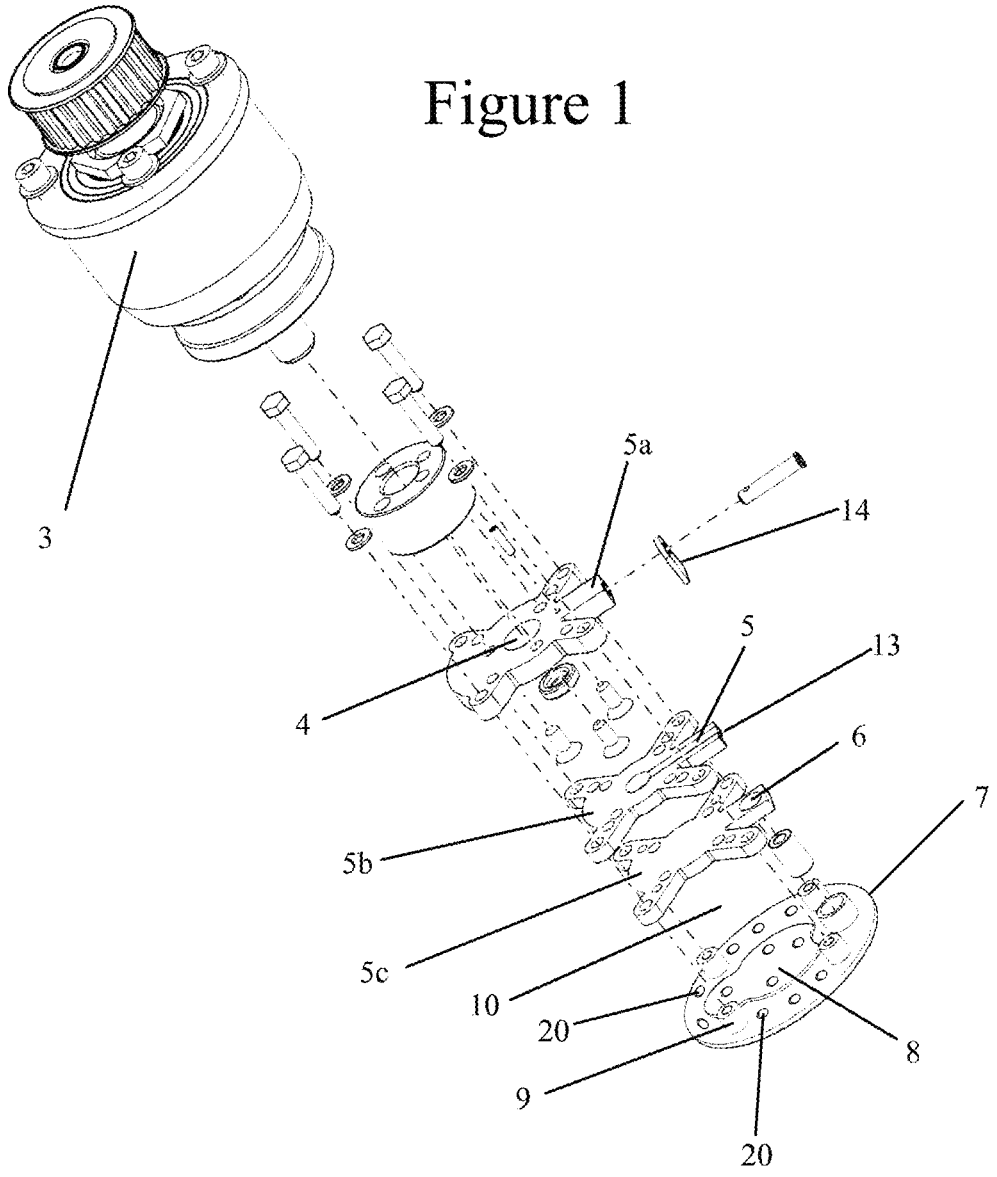
FIG. 1 is a schematic exploded view of an example of a device according to the invention.
Figure 2:
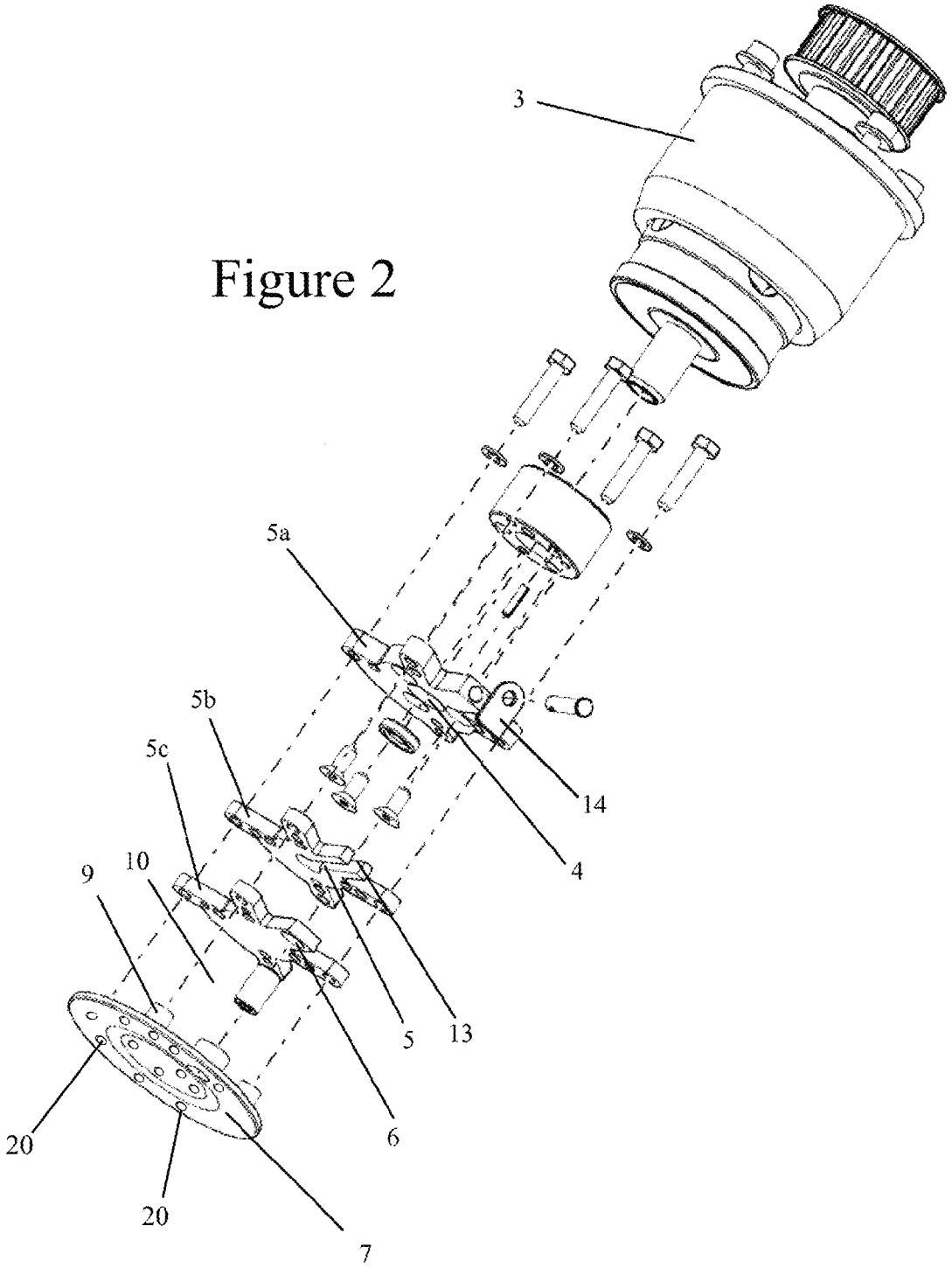
FIG. 2 is an alternative schematic exploded view of an example of a device according to the invention.
Figure 3:
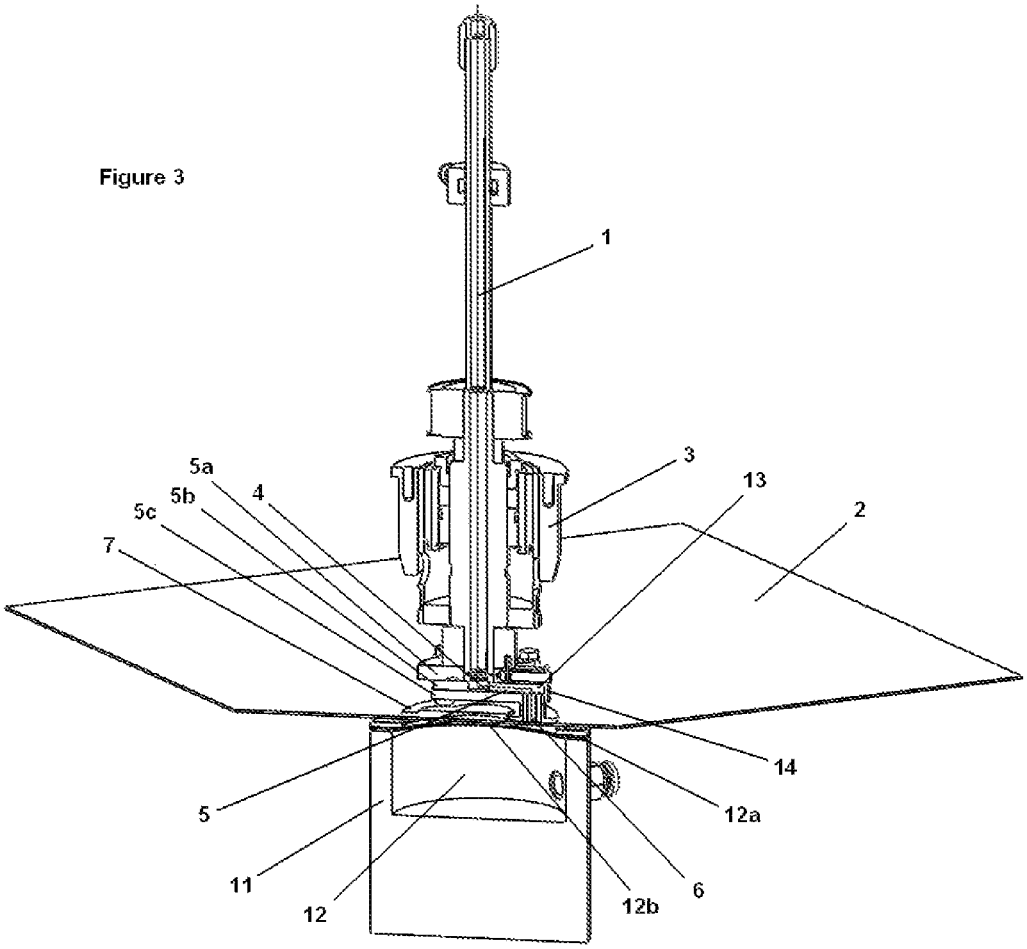
FIG. 3 is a schematic cross-sectional view of an example of a device according to the invention.

The present invention relates to a device for spreading at least one yarn 1 on a conveyor structure 2, characterized in that the device comprises:

- a rotating structure 3 operated by a motor and comprising at least one point 4 for supplying the yarn 1 in the region of the axis of rotation of the rotating structure 3;
- a channel 5 directed inside the rotating structure 3, radially in relation to the axis of rotation of the rotating structure 3, and opening out in the region of an orifice 6 for outputting the yarn 1 which is radially offset in relation to the axis of rotation of the rotating structure 3;
- a spreader plate 7 which is axially mounted on the rotating structure 3 and comprises the orifice 6 for outputting the yarn 1 and is intended to be positioned in the plane and against the surface of the conveyor structure 2.

Such an arrangement allows positioning of the orifice 6 for outputting the yarn 1 onto the periphery of the spreader plate 7. Also, rotational driving of the spreader plate 7 by the rotating structure 3 produces a circular depositing of the yarn 1. This circular depositing in the region of the output orifice 6 together with the displacement of the conveyor structure 2 allows the yarn 1 to be deposited in the form of spirals. This spreading of the yarn 1 on the conveyor structure 2 is performed in particular by virtue of the peripheral part of the surface of the spreader plate 7 in contact with the surface of the conveyor structure 2.

According to a particular constructional feature, the device for spreading at least one yarn 1 is characterized in that the spreader plate 7, whose surface is in contact with the conveyor structure 2, has at least one concave central portion. This concave arrangement not only limits the heating surface area of the plate 7 when the latter rubs against the conveyor structure 2, but also limits the parasitic friction of the plate 7 on a portion of yarn 1 already deposited in a suitable manner.

According to another particular constructional feature, the device for spreading at least one yarn 1 is characterized in that the spreader plate 7, whose surface is in contact with the conveyor structure 2, has several perforations 20 for optimizing the dispersion of heat associated with the friction.

In an alternative or also complementary manner, the device for spreading at least one yarn 1 is characterized in that the top surface of the plate 7 for spreading the yarn 1 forms a heat dissipation interface 8. According to a preferred constructional embodiment, this interface 8 is obtained by means of assembly of the plate 7 on the rotating structure 3 with the intervening arrangement of one or more spacer members 9 allowing the formation of a space 10 between the dissipation interface 8 of the plate 7 and the rotating structure 3. This space 10 allows air to pass over most of the surface of the spreader plate 7 situated on the side of the plate 7 opposite to the surface intended to make contact with the conveyor structure 2.

According to another particular constructional feature, the device also comprises a mechanism 11 for optimizing the contact between the surface of the conveyor structure 2 and the spreader plate 7. This optimization mechanism 11 has the purpose of ensuring contact between the conveyor structure 2 and the spreader plate 7 such that the yarn 1 may be spread out on the conveyor structure 2 without the friction of the plate 7 on the conveyor structure 2 causing a deterioration of this conveying structure 2, adversely affecting the depositing and the spreading of the yarn 1 or generating excessive friction likely to cause overheating of the plate 7. According to an exemplary embodiment of this contact optimization mechanism 11, the spreader plate 7 is mounted vertically movably in relation to the surface of the conveyor structure 2 so as to allow controlled positioning of the plate 7 against the conveyor structure 2. In a complementary or alternative manner the contact optimization mechanism 11 is formed by a device arranged underneath the conveyor structure 2 and configured to press the conveyor structure 2 against the surface of the spreader plate 7.

According to a specific alternative or complementary constructional feature, the contact optimization mechanism 11 comprises at least one controlled-inflation air chamber 12 which is positioned underneath the conveyor structure 2 arranged flexibly opposite the spreader plate 7. The flexible conveyor structure 2 allows a deformation of its surface so that the inflation of the air chamber 12 underneath the conveyor structure 2 allows a displacement of the surface of this conveyor structure 2 such that the conveyor structure 2 exerts an optimum pressure against the spreader plate 7. The use of an air chamber 12 to perform control of the pressure exerted between the spreader plate 7 and the conveyor structure 2 allows a degree of mechanical flexibility in the region of the zone of contact of the spreader plate 7 with the conveyor structure 2. This mechanical flexibility thus facilitates optimization of the contact of the spreader plate 7 against the surface of the conveyor structure 2. Moreover, the flexibility of the conveyor structure 2 allows deformation of its surface and, consequently, the position of the spirally deposited yarn may be maintained despite the friction between the spreader plate 7 and the conveyor structure 2.

According to a particular constructional feature of this air chamber 12, the latter comprises in particular a structure 12*a* for clamping a deformable membrane 12*b* arranged flush with the bottom side of the conveyor structure 2. With such a constructional design it is thus possible to obtain an air chamber, the deformable part of which is principally limited to a zone arranged facing the bottom side of the conveyor structure 2.

According to another particular constructional feature of the invention, the device also comprises a blowing mechanism displacing the yarn 1 from the supply point 4 of the axis of rotation toward the orifice for outputting the yarn 1 in the region of the spreader plate 7. This blowing mechanism thus allows ejection of the end of the yarn 1 in the region of the output orifice 6 without difficulty, during insertion and installation of the yarn 1 into the device, despite the bends in the circuit and the channel 5 of this device.

According to another particular constructional feature of the invention, the device also comprises a mechanism 13 for ejecting stray yarn fibers. During displacement of the yarn 1 inside the channel 5 directed radially in relation to the axis of rotation of the rotating structure 3, the different bends in the channel 5 followed by the yarn may cause the latter to lose some fibers which risk forming a flock which may result in blockage of the channel 5. An example of a fiber ejection mechanism 13 which is able to avoid said blockage may consist of an orifice 13 arranged at the end and in a radial extension of the channel 5 such that, during the rotation of the spreading device, as a result of the centrifugal force, the stray yarn fibers are ejected from the channel 5.

According to a specific feature of this constructional detail, the device comprises a mechanism 14 for closing the orifice 13 for injection of stray fibers so as to allow operation of the blowing mechanism for displacement of the yarn 1. This mechanism 14 for closing the orifice 13 may thus consist of a valve pivotably mounted about a radial axis positioned above the orifice 13 for ejection of stray fibers. This valve 14 thus allows, on the one hand, closing of the orifice 13 when there is no rotation of the device and, on the other hand, opening of the orifice 13, when rotation of the device is activated, by pivoting of the valve under the action of its inertia.

According to a particular constructional feature of the device for spreading yarn 1 according to the invention, the directed channel 5 of the device is formed by means of the arrangement, on top of each other, of at least two complementary elements 5*a*, 5*b*, 5*c* having a flat structure. These flat complementary elements 5*a*, 5*b*, 5*c* arranged on top of each other thus permit easier constructional design of structurally complex parts of the device. Moreover, such a constructional design allows simplified production from parts which have a similar initial shape and which are then separately machined. Thus, in a superimposed arrangement, a first element 5*a* has an orifice intended to be located facing the supply orifice 4 for the yarn 1, a second element 5*b* forms the channel 5 directed radially in relation to the axis of rotation of the rotating structure 3, and a third element 5*c* has the orifice 6 for outputting the yarn 1 which is radially offset in relation to the axis of rotation of the rotating structure 3.

Of course, the invention is not limited to the embodiment described and shown in the attached drawings. Modifications are possible, in particular as regards the composition of the various elements or by replacement with equivalent techniques, without thereby departing from the scope of protection of the invention.

What is claimed is:

1. Device for spreading at least one yarn on a conveyor structure, the device comprising:

a rotating structure operated by a motor and comprising at least one point for supplying the at least one yarn in a region of an axis of rotation of the rotating structure;

a channel directed inside the rotating structure, radially in relation to the axis of rotation of the rotating structure, and opening out in a region of an orifice for outputting the at least one yarn which is radially offset in relation to the axis of rotation of the rotating structure; and a spreader plate which is axially mounted on the rotating structure and comprises the orifice for outputting the at least one yarn, wherein a bottom surface of the spreader plate is positioned against a surface of the conveyor structure.

2. Device for spreading at least one yarn according to claim 1, wherein the spreader plate has at least one concave central portion.

3. Device for spreading at least one yarn according to claim 1, wherein the spreader plate has several perforations for optimizing the dispersion of heat associated with friction.

4. Device for spreading at least one yarn according to claim 1, wherein the device also comprises:

an optimization mechanism for contact between the surface of the conveyor structure and the bottom surface of the spreader plate.

5. Device for spreading at least one yarn according to claim 4, wherein the contact optimization mechanism comprises at least one controlled-inflation air chamber positioned underneath the conveyor structure arranged flexibly opposite the spreader plate.

6. Device for spreading at least one yarn according to claim 5, wherein the air chamber of the contact optimization mechanism comprises a structure for clamping a deformable membrane arranged flush with a bottom side of the conveyor structure.

7. Device for spreading at least one yarn according to claim 1, wherein the device also comprises a mechanism for ejecting stray yarn fibers.

8. Device for spreading at least one yarn according to claim 1, wherein the channel of the device is formed by an arrangement, on top of each other, of at least two complementary elements having a flat structure.

9. Device for spreading at least one yarn according to claim 1, wherein a top side of the spreader plate forms a heat dissipation interface.

* * * * *